US006098635A

United States Patent [19]

Marino

[11] Patent Number: 6,098,635

[45] Date of Patent: Aug. 8, 2000

[54] MOTORIZED, ROTATING HAIR BRUSH

[76] Inventor: Claudio Marino, 6610 Petit Ave., Van Nuys, Calif. 90406

[21] Appl. No.: 09/313,066

[22] Filed: May 17, 1999

Related U.S. Application Data

[63] Continuation-in-part of application No. 08/992,885, Dec. 18, 1997, abandoned.

[51] Int. Cl.[7] ..... A45D 6/02

[52] U.S. Cl. ..... 132/238; 132/226; 132/243

[58] Field of Search ..... 132/238, 223, 132/226, 237, 239, 240, 265, 266, 267, 271, 212, 132, 129, 134; 15/4, 23, 179, 172, 144.1

[56] References Cited

U.S. PATENT DOCUMENTS

| | | | |
|---|---|---|---|
| 54,695 | 5/1866 | Crosman | 15/144.1 |
| 431,497 | 7/1890 | Walker | 15/23 |
| 524,654 | 8/1894 | Shute | 15/179 |
| 3,431,571 | 3/1969 | Kraus | 15/179 |
| 3,890,984 | 6/1975 | Lesetar | 132/238 |
| 3,909,868 | 10/1975 | Nogues | 15/27 |
| 3,947,910 | 4/1976 | Akerman | 15/27 |
| 4,084,282 | 4/1978 | Calvert | 15/38 |
| 4,161,050 | 7/1979 | Sasaki et al. | 15/159 |
| 4,197,608 | 4/1980 | Holley et al. | 15/27 |
| 4,250,902 | 2/1981 | Ihara | 132/271 |
| 5,584,088 | 12/1996 | Pauldine | 15/27 |

FOREIGN PATENT DOCUMENTS

| | | | |
|---|---|---|---|
| 315107 | 5/1989 | European Pat. Off. | 15/23 |
| 2276794 | 1/1976 | France | 132/212 |
| 1062212 | 7/1959 | Germany | 15/23 |
| 3171977 | 3/1977 | Japan | 132/271 |
| 594382 | 1/1978 | Switzerland | 132/271 |

*Primary Examiner*—Jeffrey A. Smith
*Assistant Examiner*—Eduardo C. Robert
*Attorney, Agent, or Firm*—Oppenheimer Wolff & Donnelly LLP

[57] ABSTRACT

A rotating hair brush has several dividers between some of the rows of bristles. The dividers prevent hair from being tangled in the bristles as the brush rotates. The dividers also help smooth the hair and absorb and transfer back to the hair heat from a blow dryer. The dividers may be of many different shapes and may extend longitudinally or curve along the brush. Structure allows the brush to be removed from the handle that contains the motor and battery powering the brush. The brush also may have a guide covering part of the bristles.

45 Claims, 5 Drawing Sheets

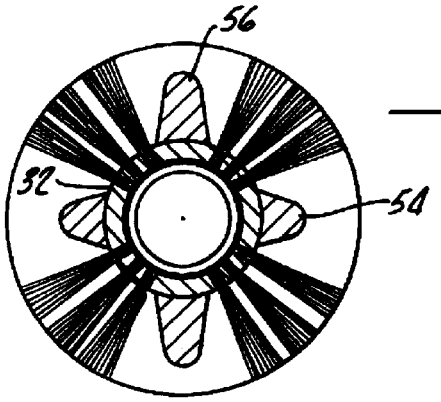
FIG. 4.
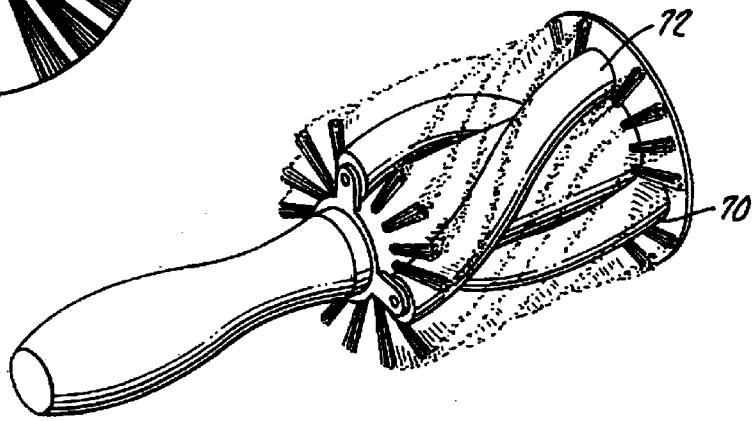
FIG. 5.
FIG. 6.
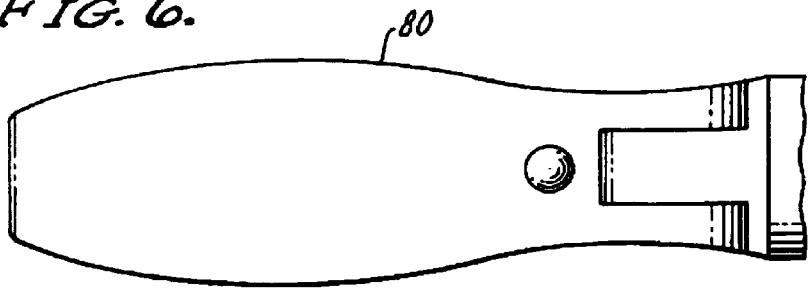
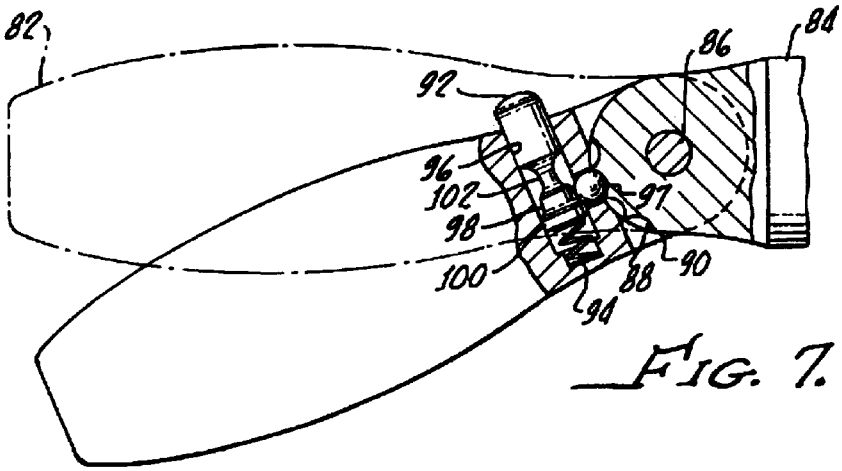
FIG. 7.

FIG. 8.
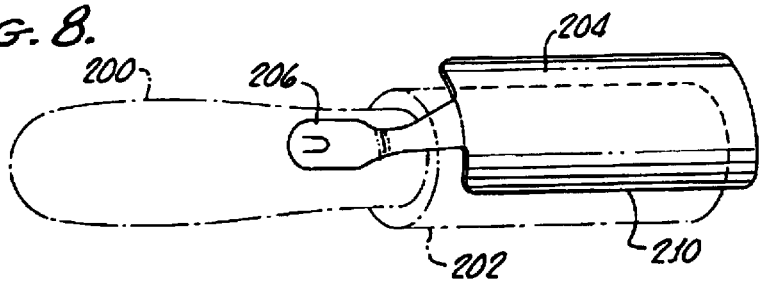
FIG. 9.
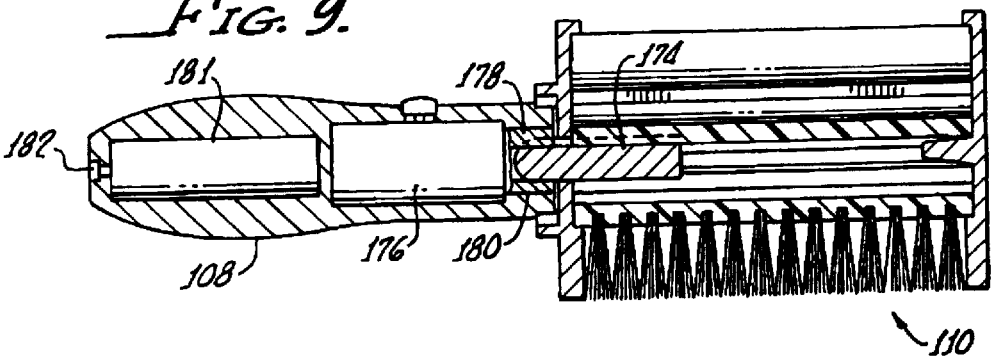
FIG. 10.
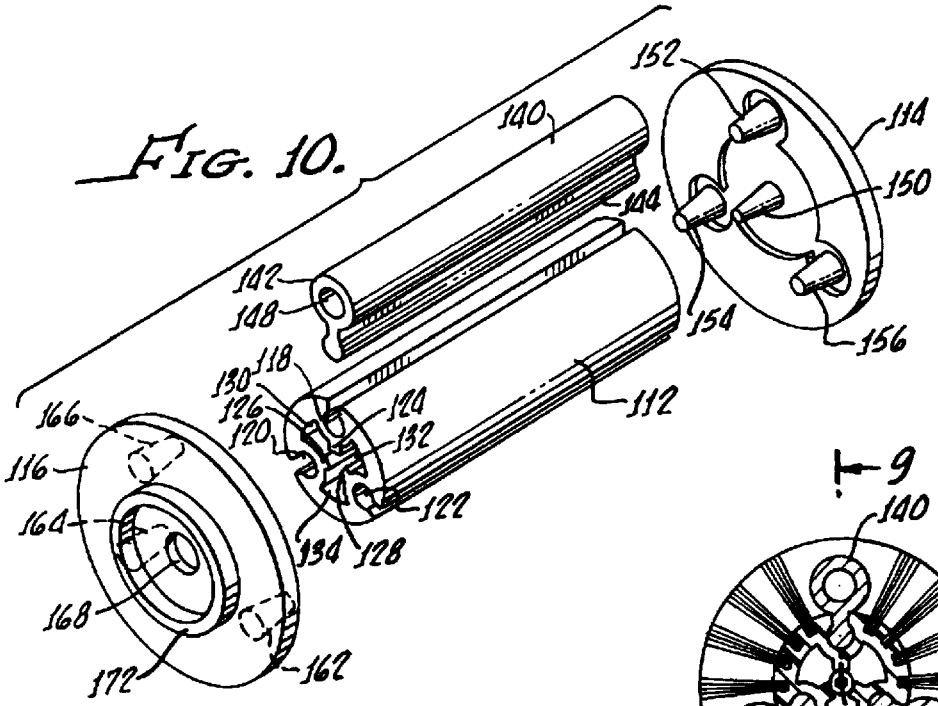
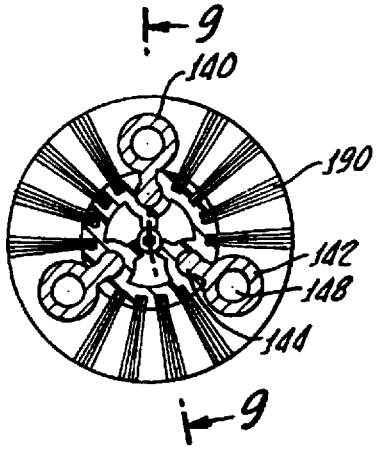
FIG. 11.

MOTORIZED, ROTATING HAIR BRUSH

1. Prior Applications

This application is a continuation-in-part of applicant's prior application, Ser. No. 08/992,885, filed Dec. 18, 1997, and now abandoned.

BACKGROUND OF THE INVENTION

2. Field of the Invention

This invention relates to a hair brush, primarily one that rotates. The movement of the bristles through the hair as the brush rotate and other features of the invention make hair brushing and blow drying faster and more effective and gives the hair body and sheen while smoothing and shaping the hair.

3. State of the Art

When blow drying hair, one achieves the best results by holding and then pulling the bristles of a hair brush such that the bristles are under a region of hair below the hair dryer. The best way to accomplish this manually is to rotates the brush partially so that the bristles move through the hair. One normally can rotate a brush about one half turn manually. After each half turn, the user pulls the brush from the hair. The brush is then replaced in a new location, usually adjacent the proceeding location.

Accomplishing rotation evenly over all regions of the scalp is very difficult because the necessary hand positions are difficult to achieve. Barbers and hair stylists can accomplish these moves more easily because they can move relative to the person's head. Blow drying one's own hair requires reaching around the head with the arms raised. Providing the proper twist or rotation to the brush is very difficult in that position. Coordinating brush movement while aiming the dryer adds to the difficulty.

The state of the art recognizes that one can rotate a hairbrush mechanically. Using such a rotating hair brush avoids the problem of having to rotate it manually in awkward positions. It is quite easy, however, with a rotating hair brush to have the brush bristles tangle the hair.

Brushing also adds body and sheen to hair. Most believe that brushing pulls oil from the scalp region and spreads it along the hair. That is why people with long hair, primarily women, may brush their hair repeatedly.

SUMMARY OF THE INVENTION

One object of this invention is to provide a motorized, rotating hair brush that decreases tangling of the hair in use, that provides blow drying to the hair as good as a hair stylist provides and that increases the heat transfer from the blow dryer to the hair. Another object is to provide a hair brush that rapidly smoothes the hair while drawing oils from hair close to the scalp to the length of the hair. The process of drawing oil along the hair adds luster, shape and body to the hair.

Other objects include optimizing the beneficial effects of a motorized, rotating hair brush. The optimization relates to the speed of rotation, the geometry and number of the bristles and dividers between the bristles, the diameter of the rotating hair brush and other factors.

One will understand additional objects from this specification.

To accomplish the objects, the brush of the present invention has a central core with bristles projecting outward from the core. In the principal embodiment, the bristles are arranged in longitudinal spaced rows. In place of some rows of bristles, dividers extend longitudinally between some of the remaining rows of bristles. These dividers project outward from the core and have relatively smooth upper surfaces that preferably are below the tops of the bristles. Ideally, there are three dividers which range from 60% to 85% of the height of the adjacent bristles. These dividers prevent the hair from tangling in the bristles as the hair brush rotates particularly at rapid, motorized speeds. As hair encounters the dividers while the brush rotates, the dividers push the hair to the distal ends of the bristles, which decreases the chance of tangling the hair in the rotating brush. As the hair passes along the surface of the dividers, the dividers tend to smooth the hair. The dividers can be cylindrical or have a curved outside shape so that the hair travels along the curve outer surface to be smoothed. The dividers also may be of different shapes and have different placements relative to the bristles.

Ideally, the materials of the divider are such that they warm when subjected to the heat of a blow dryer. They then transfer this heat to the hair to speed the drying process and increase the smoothing and shaping effect on the hair. The dividers also may be hollow with small outward-facing opening. Hair care products within the divider could flow through the openings onto the hair. The divider also could have a solid hair care product on the outer surface of the divider that would contact and be dispensed onto the hair.

One or more of the dividers can be disposable. Consequently, the core of the brush and the dividers have structure for mounting the dividers so that they can be removed from the core. The central core to which the dividers attach can be constructed so that the dividers can be removed and replaced.

The invention also contemplates having thin, solid disks at the ends of the brush to keep the hair from being tangled. Because the brush rotates, the ends of the hair could pass by the end of the brush and be twisted together. The disks keep the ends of the hair within the brush.

These and other objects of the invention may be seen more clearly from the drawings and the detailed description of the preferred embodiment that follows.

BRIEF DESCRIPTION OF THE DRAWINGS

FIG. 4 is an end sectional view of an alternate embodiment of the present invention.

FIG. 5 is a perspective view of an alternate embodiment of the present invention.

FIG. 6 is a side view of the handle of the rotating hair brush of the present invention.

FIG. 7 is another side view of an alternate embodiment of the handle. This handle allows pivoting relative to the hair brush.

FIG. 8 is a perspective view of an alternate embodiment for the rotating hair brush of the present invention.

FIG. 9 is a side, sectional view of an alternate embodiment of the present invention.

FIG. 10 is an exploded view of the brush components of an alternate embodiment of the present invention.

FIG. 11 is a side sectional view of the present invention taken through plane 11—11 in FIG. 10.

DETAILED DESCRIPTION OF THE PREFERRED EMBODIMENTS

The hair brush 10 of the present invention has a handle end 12 and a brush end or brush portion 30. The handle can be any convenient shape. Preferably, it will be made from a lightweight plastic material or other material that is resistant to corrosion and is an electrical insulator.

Figure 3:
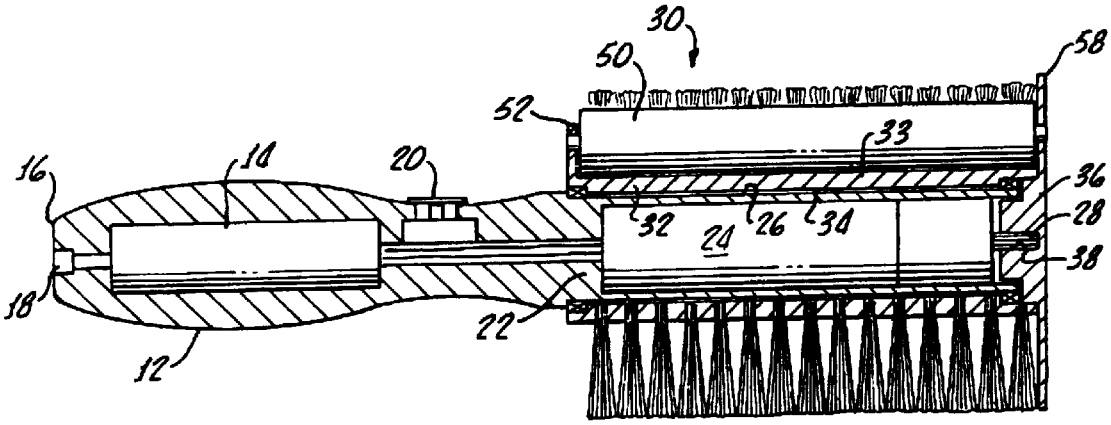
FIG. 3. is a side sectional view of the present invention taken through plane 3—3 in FIG. 2.

As FIG. 3 shows, handle 12 houses an internal battery 14, which is preferably rechargeable. The base 16 of handle 12 has appropriate structure 18 for mating with a recharging station (not shown). A conveniently located switch 20 on handle 12 controls power to the brush's motor 24. Switch 20 preferable controls the direction that the motor rotates. The user may want brush portion 30 to rotate in one direction for some regions of the scalp and in the opposite directions for other regions. The switch can also control motor speed, but a single speed may be preferable. Applicant contemplates that the brush portion will rotate at 30–140 rpm.

The handle may be made in connected sections that can be pulled apart to allow access to battery 14. Alternately, the handle may be hollow with access through a door. Though the battery is rechargeable, it can wear out after a predetermined number of recharging cycles. Access allows the battery to be changed.

The distal end 22 of handle 12 (FIGS. 1 and 3) carries brush portion 30. FIG. 3 shows that motor 24 is in the distal portion of the handle. It also could be mounted in the proximal end of the handle, closer to the battery. See FIG. 9.

In one exemplary embodiment, brush portion 30 comprises a cylindrical housing 32 (FIG. 3) that extends around the distal portion 22 of handle 12. The inside surface 34 of housing 32 and the outside surface 26 of handle portion 12 move against each other. Applicant contemplates friction reduction between the two surfaces by making them smooth, providing low friction materials such as Teflon® plastic on one or both surfaces, using external lubricants or a combination of these methods.

End cap 36 closes the end of the brush end 30 (FIG. 3). The end cap has an opening 38, that receives motor shaft 28. The opening and shaft are on the longitudinal axis of the brush portion 30 and the handle portion 12. The inside of the opening and the outside of the shaft have mating surfaces so that shaft rotation rotates the cap and the brush section.

The first exemplary embodiment shows the brush portion surrounding the motor and the shaft intersecting the distal end of the brush. Many other arrangements also are possible. If the motor is moved proximally into the handle as FIG. 9 shows, its shaft can engage the proximal end of the brush section. In place of or in addition to a shaft, the handle could have a rotating cup or other opening that receives a projection from the brush end. Some alternate embodiments including those that FIG. 9 shows are discussed below.

Making the brush section removable from the handle is desirable. One can use different brush designs if each can be removed. Also, one may remove a brush for cleaning it. Furthermore, if bristles break, one can exchange a damaged brush with a new one.

Though the drawings of the first exemplary embodiment shows no structure for locking the brush end to the motor output, one could be provided. For example, one could use a detent fitting into an indentation. A bayonet fitting also could be used. It is beneficial to make the connection between the handle and the brush section rigid so the brush does not wobble as it rotates.

Instead of switch 20 merely being an on-off switch, the switch could allow for a change of the direction of rotation. For example, pushing the switch could start rotation, but sliding it to either side could specify the direction of rotation. The switch also could control speed of rotation. It can be instant off upon release, or it can be pushed to turn on and pushed again to turn off. These types of switches are common in electric screwdrivers and power tools, and a similar switch could be used with the present invention.

Figure 1:
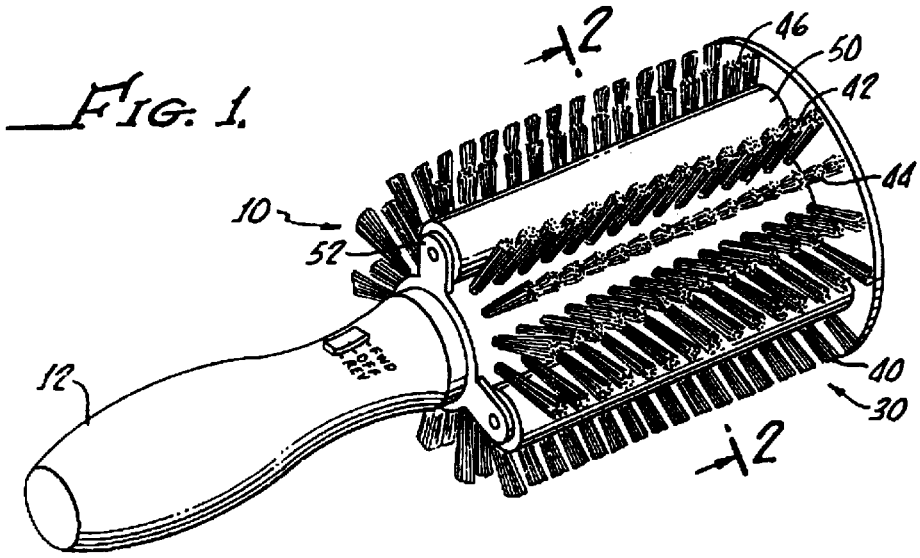
FIG. 1 is a perspective view of the rotating hair brush of the present invention.
Figure 2:
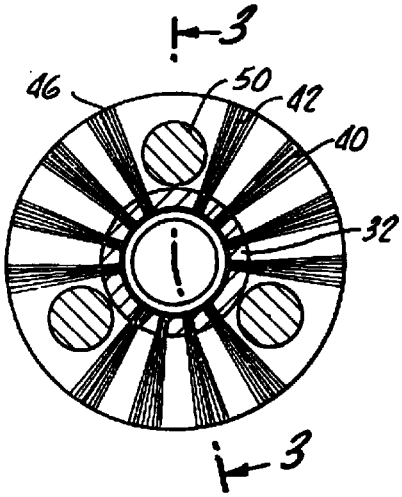
FIG. 2 is a sectional view of the present invention taken through plane 2—2 in FIG. 1.

Bristles 40 extend outward from the cylindrical core 33. These bristles would be attached to the core in conventional ways and are arranged in rows, e.g., rows 42, 44 and 46 (FIG. 1). As FIG. 2 shows, the brush has twelve rows of bristles arranged generally circumferentially around the core 33. The FIG. 12 exemplary embodiment has fifteen rows of bristles 220, and the FIG. 13 embodiment has eight rows of bristles. One may use different types of bristles and still achieve satisfactory results. It is also known to use different types of bristles with different types of hair.

In place of the row of bristles that would be between rows 42 and 46 (FIGS. 1–3), the present invention has an anti-tangle divider element 50. In the exemplary embodiment, the divider is an elastomer such as silicone rubber or TPE. It does not have to be very smooth or slick such as Teflon® because some friction between the divider and hair may be desirable. Silicone rubber or TPE are desirable because of their softness. The materials also help pull oils uniformly from the scalp and the hair close to the scalp to the ends of the hairs. The materials also draw out and smooth each strand.

Professionals brushing properly can spread the oil on each hair strand while smoothing the shaping the hair. Brushing the hair many times in succession also separates and draws out each strand while spreading the oil. It is the basis for brushing the hair with 100 strokes. The transfer of oil along each hair to the end is one reason that hair has more body and sheen and looks better overall after professional brushing.

Divider 50 extends the entire length of a row of bristles. See FIGS. 1 and 3. Flange 52 and end cap 36 secure divider 50 in its location between the rows of bristles and against the cylindrical core. The divider could rotate about its supports, but the divider does not rotate in the exemplary embodiment.

Each divider in the exemplary embodiment has a rounded distal surface. The dividers are cylindrical in FIGS. 2, 12 and 13, but they have different shapes in FIGS. 4 and 14 through 18. Also, FIGS. 2 and 12 have three dividers, but FIGS. 4 and 13 have four dividers. The number of dividers is a matter of choice. They should not be so numerous as to eliminate all bristles. However, there should be enough to perform their function.

Another function for the dividers is to prevent hair from tangling in the bristles. Especially when hair is wet, brush rotation can carry ends of the hair around the brush. The hair ends then can get under other parts of the hair and tangle. The dividers tend to smooth the bottom of the hair and push it outward to make it less likely to tangle.

The dividers also retain heat. As hot air from a blow dryer hits the hair and the divider, the divider warms. The divider's heat transfers back to the hair even when hot air from the blow dryer is directed elsewhere. One also could preheat the dividers by aiming the hair dryer at the dividers before directing air to the hair.

Three dividers with cylindrical or other curved shaped distal surfaces is the optimum. Ideally, the distal surface of the divider is between 60% and 85% of the height of the bristles. In one exemplary embodiment for medium-long hair, each bristle is about 0.96 in. long. The diameter of the cylindrical housing 32 is 0.7 in. Ideally, the divider is 0.675 in. in diameter. Therefore, the ratio of the divider diameter to the bristle radius is 0.675/0.96=70%. In another exemplary embodiment—for longer hair—each bristle is about 1.22 in. long. In this embodiment, applicant uses a divider that is 1.0 in. in diameter. Therefore, the ratio of the divider diameter to the bristle length is 1.0/1.22=82%.

Figure 12:
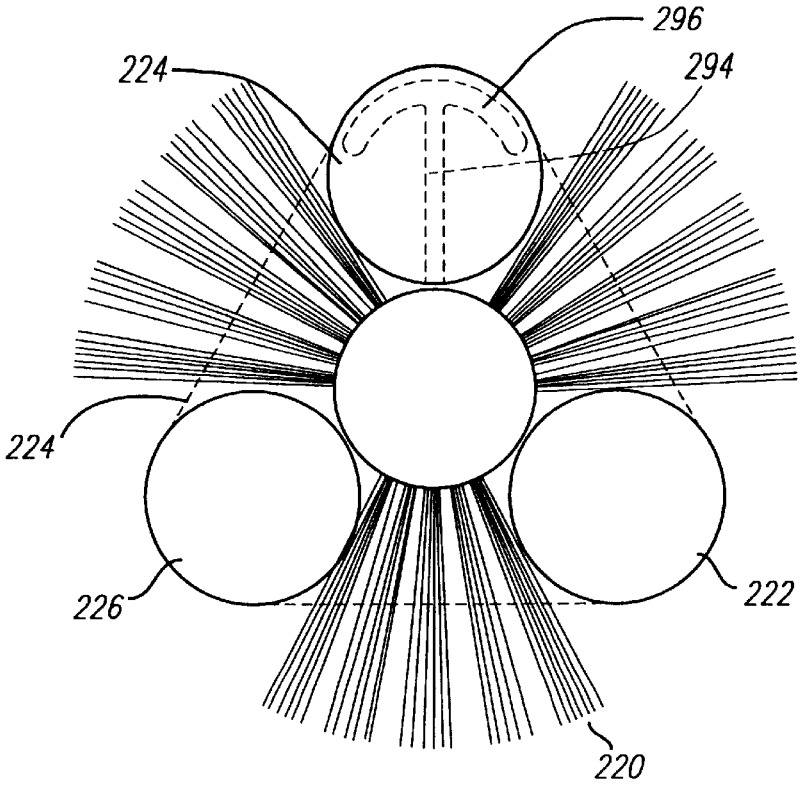
FIG. 12 is a sectional view similar to FIG. 2 and is taken through a plane perpendicular to the brush portion of the present invention.
Figure 13:
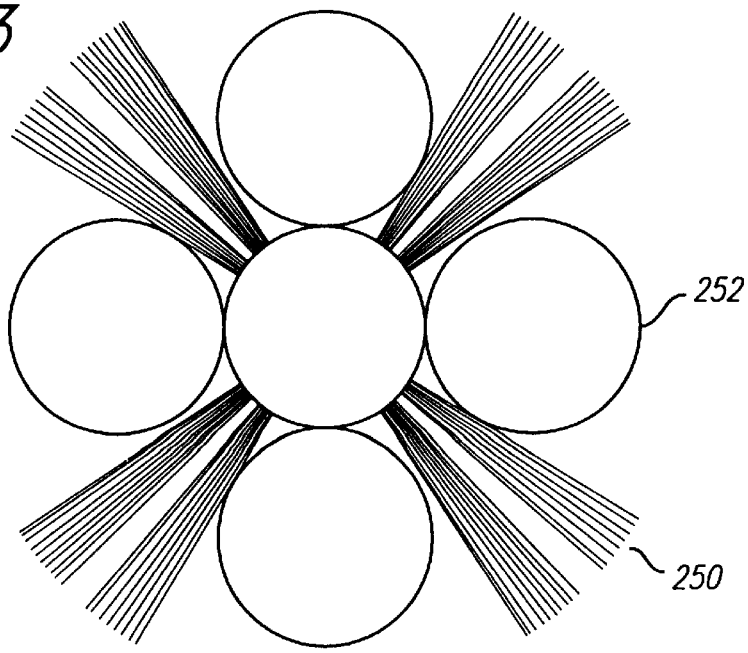
FIG. 13 is a sectional view similar to FIG. 12 but is an alternate embodiment.
Figure 18:
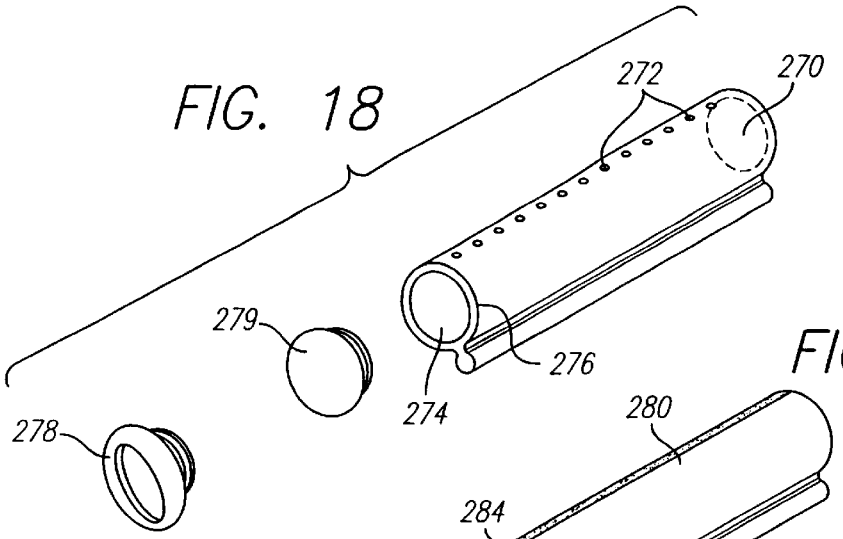
FIG. 18 is an exploded perspective view of an alternate divider used in the present invention.

FIG. 13 (and FIG. 4) have four dividers. As explained in more detail below, dividers 54, FIG. 4, are not cylindrical, but each has a cylindrical distal surface 56. The dividers 222 in FIG. 12 are cylindrical.

One can visualize the three dividers in FIGS. 2 and 12 as forming the curved apexes of a triangle 224 (FIG. 12). The shape is ideal. As the brush rotates, the dividers "kick" the hair to prevent it from tangling in the brush. The three-divider design also provides for sufficient curved surface contacting the hair to smooth, shape and add volume to the hair. At the same time, enough bristles engage the hair to separate the hairs and brush them efficiently.

In FIG. 13, the four dividers 252 would act as curved apexes of a square. This design has a slightly greater tendency for hair to tangle. Though it provides a greater divider surface for contacting the hair, fewer bristles contact the hair. Therefore, brushing efficiency suffers. For some types and lengths of hair, however, four dividers may provide equal or superior results than three dividers.

Using two dividers provides even greater bristle engagement, but two-divider brushes are not stable and tend to be more difficult to control. The divider-to-divider transition as the brush rotates is not smooth. Consequently, the three-divider system remains the optimum.

In FIG. 4, the proximal surfaces of dividers 54 and 56 conform to the cylindrical housing 32. They may be attached by adhesive, mechanical fasteners or interlocking press fit. See FIGS. 9 and 10 and their associated discussion for an exemplary embodiment that uses an interlocking press fit attachment. Using this alternative attachment methods avoids having to use a flange such as flange 52 (FIGS. 1 and 3), to anchor the dividers to the cylindrical core.

In all embodiments shown, the dividers are continuous, extending along the entire length of each row of bristles. Though not shown in the drawings, having spaces between sections of the divider may be desirable. These spaces also may be staggered so that adjacent dividers do not have spaces aligned with each other.

The end cap 36 may have a disk portion 58, which extends to the ends of bristles 40 (FIGS. 1 and 3). The disk may also extend slightly beyond the bristle ends. The disk helps prevent hair from falling over the end of the brush where brush rotation could twist the hair. The brush also may have an additional disk at its other end. That disk also could provide anchoring in lieu of the flanges 52 for the divider members.

In FIGS. 1 through 4, each divider extends longitudinally in a straight line. The dividers 70 in the FIG. 5 embodiment are curved. The rows 72 of bristles also are curved to accommodate the curved dividers.

All the dividers shown in the exemplary embodiment have rounded surfaces. The invention also contemplates having a divider with a distal edge.

Because preheating the dividers may be desirable, each divider may have an electric coil to heat the divider. This coil can receive power while the battery 14 is recharging. Alternately, the brush portion 30 could have its own connection to electricity. Before use, one could close a circuit to direct power into the coil.

FIGS. 1 and 3 show an aligned brush end on the handle so that the brush rotates around the longitudinal axis of the handle. Some may find it awkward to position the brush properly if the brush is aligned with the handle. Therefore, the embodiment in FIGS. 6 and 7 has the ability to pivot the brush end and handle relative to each other.

Handle 80 (FIGS. 6 and 7) has a proximal portion 82 and a distal portion 84. They pivot with respect to each other about pin 86. A portion of the distal end 84 has a series of indentations 88 along an arc of a circle 90 whose center is at the shaft 86. The proximal end 82 of handle 80 has a detent mechanism for engaging one of the indentations 88. The detent mechanism in the exemplary embodiment has a short shaft 92 extending perpendicular to the longitudinal axis of the handle. A compression spring 94 urges the shaft 92 outward. A flange intersects with a shoulder (not shown) on the inside of handle bore 96 to prevent removal of the shaft from the handle. A ball detent 97 (FIG. 7) mounts in an opening 98 between shaft 92 and indentations 88. Shaft 92 has spaced surfaces with different outside diameters. When the shaft is in its outer-most position, a wider diameter portion 100 prevents ball detent 97 from moving (to the left in FIG. 7) out of one indentation. When the user pushes downward on shaft 92, the shaft presents a smaller diameter portion 102 over the ball detent 96. The ball detent can then move out of one indentation. When the ball detent is locked in an indentation, one cannot rotate the proximal portion 82 of the handle with respect to the distal end 84. Rotation is possible when the ball detent is not within one indentation 90. Many other ways of pivoting and locking the two handle portions relative to each other are known to those of ordinary skill.

Having the motor in the brush portion as FIG. 3 shows offers advantages when the two handle sections pivot relative to each other. The electrical wires between the battery and the motor can accommodate the pivoting of the sections of the handle. If the motor is in the proximal section of the handle, an intermediate universal mechanism or a flexible drive will be necessary to accommodate the pivoting.

In an alternative embodiment, which FIGS. 9, 10 and 11 show, the brush portion 110 is removable from the handle 108. The brush portion contains three major parts, a central core 112, distal end cap 114 and proximal cap 116. Core 112 is formed of extruded plastic. It is generally cylindrical with three longitudinal outside grooves 118, 120 and 122. These grooves are above corresponding inward projections 124, 126 and 128. These inward projections create three spaces 130, 132 and 134. Though FIGS. 10 and 11 show three grooves, inward projections and spaces, the core could have a different number of each.

The dividers 140 in this exemplary embodiment have a cylindrical distal portion 142 and an elongated tab 144 (FIGS. 10 and 11). Each tab's shape corresponds to the shape of the grooves 118, 120 and 122. FIG. 11 shows the tabs of three dividers held within the grooves.

Distal end cap 114 in this exemplary embodiment is formed of an elastomeric material. It includes a central inwardly-projecting conical pin 150 and three spaced inwardly-projecting conical pins 152, 154 and 156 (FIGS. 10 and 11).

Distal end cap 114 attaches to the core 112 through a press fit arrangement in which central conical pin 150 is inserted between inward projections 124, 126 and 128. Similarly, each of the three spaced inwardly-projecting conical pins 152, 154 and 156 are inserted and press fit into the space 148 in the cylindrical portion 142 of each divider 140 (FIGS. 10 and 11).

Likewise, proximal end cap 116 has three spaced, inwardly-projecting conical pins 162, 164 and 166 (FIG. 10 in phantom). These pins are press fit into the other space 148 in the cylindrical portion 142 of each divider 140 (FIGS. 10 and 11). The end cap 116 also has a central opening 168 (FIG. 10) and an annular wall 172 projecting from the proximal surface of the end cap 116. Shaft 174 (FIG. 9) projects from motor 176 through opening 168 and between inward projections 124, 126 and 128.

Shaft 174 can be removed from the inward projections, which allows the remaining structure of the brush section 110 to be removed from the handle 108. Alternatively, the shaft 174 can attach in a removable fashion to an opening 178 in the motor output member 180. In that case, the shaft 174 would stay with the brush portion 110 when the brush is removed from the handle 108. The proximal end of the shaft 174 can have a non-circular shape, and the opening 178 would have a corresponding shape. The shaft 174 or the opening 178 also can be elastomeric so that they can press fit together.

The annular projection 172 on the outside of end cap 116 fits around the outside of the handle 108 (FIG. 9). This acts to guide the brush portion 110 as it rotates.

The handle also houses a battery 181 to drive the motor 176. FIG. 9 also shows structure 182 for recharging the battery.

The dividers are hollow in the exemplary embodiment to reduce weight. They could be solid also. Similarly, hollow dividers could be capped at their ends, or the ends could remain open. Closing the ends prevents anything from going into the divider.

As in the previous embodiments, bristles 190 attached to the core 112 extend outward from the core (FIG. 11). Three dividers 140 project outward from the core in place of three row of bristles.

Caps 114 and 116 also perform the same function that the disk portion 58 of end cap 38 (FIGS. 1 and 3) performs. The outer surface, which may extend slightly beyond the bristle ends, prevents hair from falling over brush end where brush rotation could twist the hair.

FIG. 8 shows still another embodiment. In it, a flange 206 of guard member 204 attaches to the handle 200. The guard portion 204 is space from the top of the bristles in the brush portion 202. The user normally places one edge 210 against the scalp. This position places the brush's bristles at a preferred distance near the base of each strand of hair. It also allows the user to "feel" the proper positioning of the brush.

The invention also contemplates using one or more of the dividers for dispensing hair care formulations. Consequently, in FIG. 18, divider 270 has a series of small openings 272. One would then fill the inside 274 of the divider with liquid or semi-liquid hair care formulations such as gels, conditioners or oils. As the hair brush rotates, these hair care products would flow directly onto the hair in controlled amounts. By coupling the rotation and the dispensing, the dispensing is facilitated and results in a more uniform dispersal of the product onto the hair. Without the present invention, many of these products were either sprayed or hand rubbed into the hair, which often cause uneven application.

The dispensing dividers may be filled and refilled or be replaced. For refilling, one end 276 is closed by threaded cap 278 which the user can remove and replace. If the dividers may be replaceable, the user buys them pre-filled. In that case, alternate end cap 279 is held by adhesive or sonic welding in the divider after the opening is filled with the hair care formulation.

Figure 17:
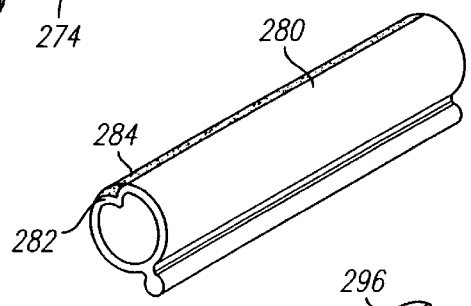
FIG. 17 is a perspective view of an alternate divider used in the present invention.

One could also dispense hair care products by using a semi-solid line of hair care product attached to the outside of one or more dividers. As FIG. 17 shows, divider 280 has a slight indentation 282. That indentation is filled with semi-solid hair care product 284. The indentation is deep enough so that the hair care product in its configuration maintains the cylindrical shape of a regular divider. One could use such a divider in place of a regular divider, or multiple dividers could have this feature.

Figure 16:
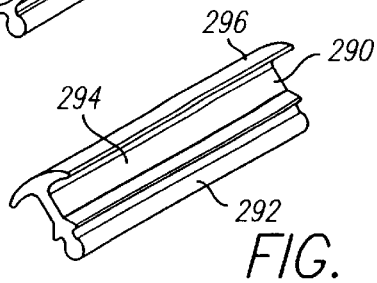
FIG. 16 is a perspective view of an alternate divider used in the present invention.

In place of a complete cylinder, the present invention contemplates a T-like divider, with a distal surface conforming to a cylinder. In FIG. 16 for example, divider 290 has a tab 292 that fits within a groove such as groove 118 (FIG. 10). A brace 294 extends upward from the tab and terminates in a curved distal outer surface 296. See also FIG. 12 where a cross section of the FIG. 16 divider is shown in phantom. The distal surface 296 is shown to conform to the outer surface of cylinder 224.

Figure 15:
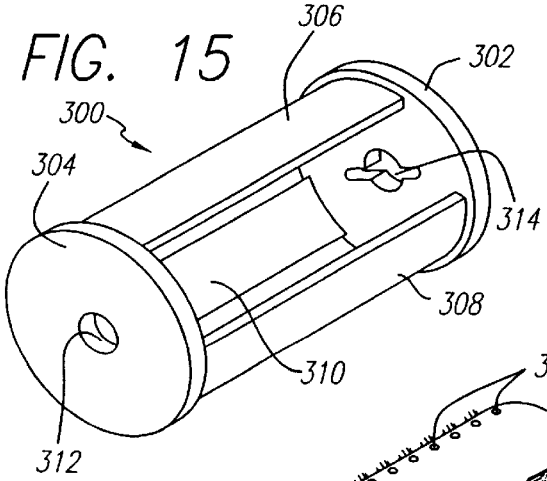
FIG. 15 is another perspective view of an alternate brush portion without the bristles.

In another alternative, FIG. 15 shows a cage-like brush portion 300. Three curved bars 306, 308 and 310 attach to end disks 302 and 304. The bristles, which are not shown, are inside the cage-shaped structure. Disk 304 has an opening 312 through which the shaft extends until it engages opening 314. As with the other embodiments, the motor shaft rotates the cage 300 and the bristles between them.

Figure 14:
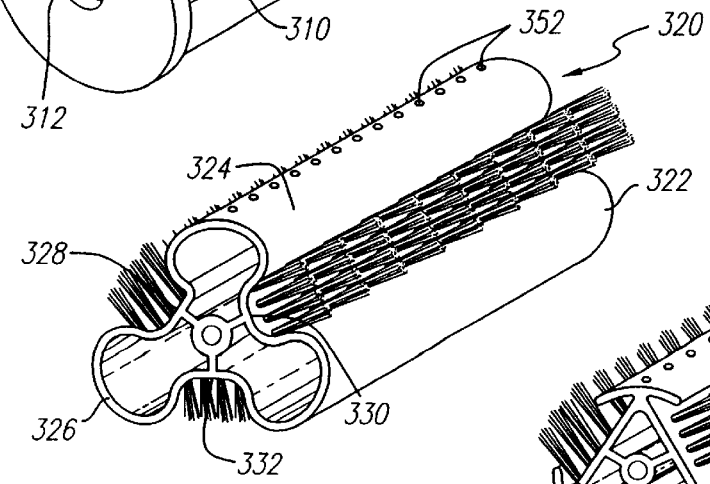
FIG. 14 is a perspective view of an alternate brush portion of the present invention.
Figure 19:
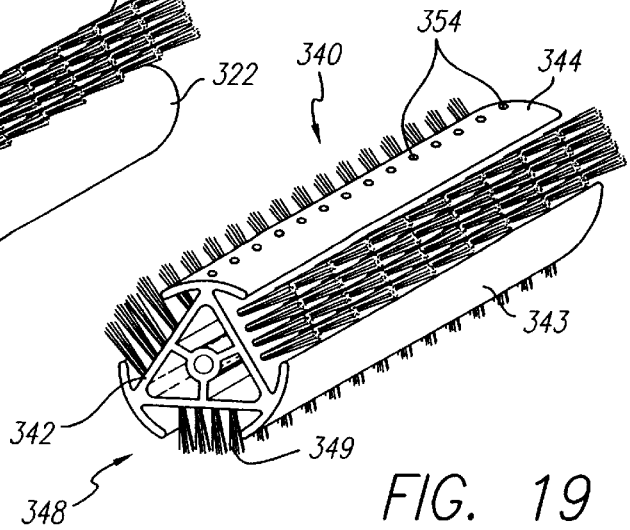
FIG. 19 is a perspective view of an alternate brush portion of the present invention.

FIGS. 14 and 19 show different possible constructions that use a single extrusion. In FIG. 14, the extrusion that forms the brush portion 320 forms three dividers 322, 324 and 326. Each divider has a cylindrical or other curved outer surface. The flat or reversed curved surfaces 328, 330 and 332 between the dividers are regions for attaching the bristles.

The brush portion 340 in FIG. 19 has a triangular center 342. The curved distal surfaces 344, 346 and 348 are at the apex of the triangle. Bristles 350 attach to the triangle's legs and extend through openings between the curved surfaces. Both the embodiments in FIGS. 14 and 19 are formed easily with extruded materials.

One or more of the dividers sections of the single extrusions embodiment in FIGS. 14 and 19 could have dispensing openings 352 and 354, respectively. They are similar to openings 272 in FIG. 18. Appropriately configured sealing caps similar in principle to cap 279 in FIG. 18 could be provided. One also could provide internal ribbing within the extrusions for added strength. The ribbing also could isolate one of the dividers 332, 324 or 326, which would contain hair care formulations, from the other dividers.

Many modifications and alternate embodiments will occur to those skilled in the art. Therefore, the applicant intends that the invention is limited only in terms of the appended claims.

I claim:

1. A rotating hair brush comprising:

a. a handle;

b. an elongated core rotating about the handle, the core having a longitudinal length and a longitudinal axis, and a plurality of bristles extending outward from the core from a proximal end attached to the core to a distal end;

c. divider means between some of the bristles extending from the core to a distal surface adjacent the distal end of the bristles to which the divider is adjacent, the distal surface having a curved distal surface, the divider means being positioned to contact and push hair away from the longitudinal axis of the core as the core rotates.

2. The brush of claim 1 wherein the divider means extends at least substantially the entire length of the core.

3. The brush of claim 1 wherein the bristles are arranged in rows extending parallel to the longitudinal axis of the core, the divider means comprising at least one divider element being between at least two of the rows of bristles.

4. The brush of claim 1 wherein the bristles are arranged in rows extending parallel to the longitudinal axis of the core, the divider means comprising a plurality of divider elements, each divider element being between at least two of the rows of bristles.

5. The brush of claim 1 wherein the divider means comprises at least one divider element, at least one of the divider elements is cylindrical.

6. The brush of claim 1 wherein the core has a distal end and a proximal end, the divider means comprising at least one divider element, the brush further comprising a support on each end of the core extending to and attached to the divider for holding the at least one divider element to the core.

7. The brush of claim 1 wherein the core has a distal end and a proximal end, the brush further comprising a disk mounted perpendicular to the longitudinal axis of the core and being mounted at one end of the brush, the disk having an outer surface such that the outer surface of the disk terminates adjacent to distal ends of the bristles.

8. The brush of claim 1 wherein the core has a longitudinal axis, a distal end and a proximal end, the brush further comprising two disks each mounted perpendicular to the longitudinal axis of the core and being mounted at the distal and proximal ends of the core, the disks each having outer surface such that the outer surface of each disk terminates adjacent to distal ends of the bristles.

9. The brush of claim 8 wherein the divider means comprising at least one divider element, each divider element has a surface adjacent the elongated core, the divider element being attached to the core.

10. The brush of claim 1 wherein the divider means comprising at least one divider element, and wherein the core has a distal end and a proximal end, the brush further comprising a support on each end of the core extending to and attached to the divider for holding the divider to the core, at least one of the supports having a portion extending into a portion of a divider element.

11. The brush of claim 10 wherein the at least one of the supports further comprising a central portion located near the longitudinal axis of the core, the central section extending into the core.

12. The brush of claim 1 further comprising a guard spaced from the bristles and covering a portion of the bristles.

13. The brush of claim 1 wherein each divider element extends between 60% to 85% of the distance from the core to the distal end of the bristles.

14. A hair brush comprising:

a. a handle and a brush portion mounted for rotation on the handle;

b. the brush portion having an elongated core, the core having a longitudinal length and a longitudinal axis, and a plurality of bristles extending outward from the core from a proximal end attached to the core to a distal end;

c. divider means between some of the bristles extending from the core to a distal surface for contacting the user's hair and pushing the hair outward, away from the bristles as the divider means contacts hair during rotation of the core, the divider means comprising at least one divider element, the at least one divider element extending from the core to a distal surface adjacent the distal end of the bristles to which the divider is adjacent, the distal surface having a curved distal surface.

15. The brush of claim 14 wherein the divider element extends at least substantially the entire length of the core.

16. The brush of claim 14 wherein the bristles are arranged in rows extending parallel to the longitudinal axis of the core, the divider element being between at least two of the rows of bristles.

17. The brush of claim 14 wherein the bristles are arranged in rows extending parallel to the longitudinal axis of the core, a plurality of dividers, each divider element being between at least two of the rows of bristles.

18. The brush of claim 14 wherein at least one of the divider elements is cylindrical.

19. The brush of claim 14 wherein the core has a distal end and a proximal end, the brush further comprising a support on each end of the core extending to and attached to the divider for holding the divider element to the core.

20. The brush of claim 14 wherein the core has a distal end and a proximal end, the brush further comprising a disk mounted perpendicular to the longitudinal axis of the core and being mounted at one end of the brush, the disk having an outer surface such that the outer surface of the disk terminates adjacent to distal ends of the bristles.

21. The brush of claim 14 wherein the core has a longitudinal axis, a distal end and a proximal end, the brush further comprising two disks each mounted perpendicular to the longitudinal axis of the core and being mounted at the distal and proximal ends of the core, the disks each having outer surface such that the outer surface of each disk terminates adjacent to distal ends of the bristles.

22. The brush of claim 14 wherein the handle has a distal end and a proximal end, the distal end being received within the core of the brush portion.

23. The brush of claim 22 wherein the distal and proximal ends of the handle pivot with respect to each other.

24. The brush of claim 14 wherein each divider element has a surface adjacent the elongated core and corresponding to the surface of the core, the divider element being attached to the core along the adjacent surfaces of the core and the divider.

25. The brush of claim 14 wherein the core has a distal end and a proximal end, the brush further comprising a support on each end of the core extending to and attached to the divider element for holding the divider to the core, at least one of the supports having a portion extending into a portion of a divider element.

26. The brush of claim 14 wherein the at least one of the supports further comprising a portion that extends into the core.

27. The brush of claim 14 further comprising a guard spaced from the bristles and covering a portion of the bristles.

28. The brush of claim 14 wherein the distal surface of at least one divider element is positioned to contact hair as the core rotates.

29. A method of brushing hair comprising:

a. rotating a series of bristles on a hair brush about an axis of rotation under the hair, the bristles extending outward from a central core of the brush to a distal end;

b. revolving at least one divider on the hair brush about the axis of rotation between the bristles under the hair, the dividers extending outward from the central core to a distal surface, the distal surface being positioned to contact the hair as the divider revolves, and the distal surface pushing the hair away from the axis of rotation as the divider revolves.

30. The method of claim 29 further comprising blowing hot air toward the hair and the bristles and dividers while the bristles and dividers revolve about the axis of rotation.

31. The method of claim 29 wherein the step of rotating a series of bristles takes place at between 30 and 140 revolutions per minute.

32. A rotating hair brush comprising, an axis of rotation, a plurality of bristles extending outward away from the axis of rotation, the bristles revolving about the axis of rotation, at least one divider between some of the bristles, the at least one divider revolving about the axis of rotation and having a surface positioned to contact hair as the bristles travel between parts of the hair, the hair brush further comprising a central core around the axis of rotation, the at least one divider having a hollow cylinder extending outward from the central core and a tab connecting the hollow cylinder to the central core, the hollow cylinder having at least one opening to permit fluid to flow from inside the cylinder through the opening to the outside of the cylinder.

33. The brush of claim 32 wherein the at least one divider has a curved surface that contacts the hair.

34. The brush of claim 32 further comprising a central core around the axis of rotation, the at least one divider having a cylindrical outer surface and a tab connecting to the central core.

35. The brush of claim 30 wherein the at least one divider extends between 60% to 85% of the length of the bristles.

36. The brush of claim 32 wherein the at least one divider extends between 60% to 85% of the length of the bristles.

37. A hair brush comprising a handle, a motor and a rotating core, the motor rotating the core relative to the handle, the core having a length, a circumference and an axis of rotation, a plurality of bristles attached to the core and projecting outward from the core to a distal end for pushing hair away from the core, at least two dividers attached to the core and projecting outward from the core to a distal end, the divider means being between some of the bristles, each divider being circumferentially wider than a bristle, each divider having a curved distal surface facing away from the core to contact hair as core rotates.

38. The hair brush of claim 37 wherein the divider means comprises the dividers evenly space circumferentially about the core.

39. The hair brush of claim 37 wherein the height of each divider from the core to the distal surface of the divider is between 60% and 85% of the height of the longest bristle from the core to the distal end of the bristle.

40. The hair brush of claim 37 wherein the core rotates at between 30 and 140 revolutions per minute.

41. The hair brush of claim 37 wherein the core rotates at between 30 and 140 revolutions per minute.

42. The hair brush of claim 37 wherein the height of each divider means from the core to the distal surface of the divider means is between 60% and 85% of height of the longest bristle from the core to the distal end of the bristle.

43. The hair brush of claim 42 wherein the core rotates at between 30 and 140 revolutions per minute.

44. The hair brush of claim 42 wherein the distal surface is curved.

45. A rotating hair brush for brushing hair comprising:

a. a handle;

b. an elongated core attached to the handle, the core having a longitudinal length and a longitudinal axis, and a plurality of bristles extending outward from the core from a proximal end attached to the core to a distal end;

c. a motor for rotating the core relative to the handle;

d. divider means between some of the bristles extending from the core to a distal surface for contacting the user's hair and pushing the hair outward, away from the bristles as the divider means contacts hair during rotation of the core.

* * * * *